United States Patent [19]

Kopp

[11] Patent Number: 4,517,870

[45] Date of Patent: May 21, 1985

[54] MACHINE FOR MANUFACTURING A TEMPLATE FOR EDGE GRINDING A SPECTACLE LENS

[75] Inventor: Hubert Kopp, Schramberg, Fed. Rep. of Germany

[73] Assignee: Breitfeld & Schliekert GmbH, Bad Vilbel, Fed. Rep. of Germany

[21] Appl. No.: 495,018

[22] Filed: May 16, 1983

[30] Foreign Application Priority Data

May 15, 1982 [DE] Fed. Rep. of Germany ..... 3218492

[51] Int. Cl.[3] ..... B26D 5/00

[52] U.S. Cl. ..... 83/411 R; 51/101 LG; 83/565; 83/916; 409/104; 409/112; 409/122; 409/123

[58] Field of Search ..... 83/565, 916, 410, 411 R; 144/145 R, 154; 409/92, 93, 97, 104, 112, 122, 123; 51/101 LG, 101 R

[56] References Cited

U.S. PATENT DOCUMENTS

| | | | |
|---|---|---|---|
| 2,739,511 | 3/1956 | Rafart | 409/112 |
| 3,144,798 | 8/1964 | Leibinger | 83/916 X |
| 3,170,374 | 2/1965 | Clar | 409/104 X |
| 3,555,739 | 1/1971 | Novak | 409/122 |
| 3,786,600 | 1/1974 | Bloxsom | 51/101 LG |
| 3,838,623 | 10/1974 | Schell | 144/145 R |

*Primary Examiner*—James M. Meister
*Attorney, Agent, or Firm*—Kurt Kelman

[57] ABSTRACT

A machine for manufacturing a templet for edge grinding a spectacle lens according to the shape of an opening in a spectacle frame designed to hold the lens, comprises a spectacle frame holder supported on a housing. A copying sensor is mounted on the housing for rotation about the axis of the opening and for rectilinear displacement, the sensor sensing the shape of the opening upon rotation thereof. A blank holder is rotatable synchronously with the sensor and a sliding carriage is mounted on the housing for rectilinear displacement with respect to the blank holder, the sliding carriage carrying a cutting tool for cutting the blank to provide said templet. A plunger is rectilinearly displaceable with the copying sensor and synchronously controls the rectilinear displacement of the sliding carriage and cutting tool, the plunger having an axis extending in the direction of the axis of the spectacle frame opening. A sensing element is mounted in the housing coaxially with the plunger and spaced therefrom for sensing the distance between the plunger and the sensing element, and a mechanical motion transmission connects the sensing element to the sliding carriage. A drive motor for rectilinearly displacing the sliding carriage is connected to an electronic processing unit and to the sensing element, the processing unit controlling the rotational speed of the drive motor so that the distance between the plunger and the sensing element remains constant.

1 Claim, 3 Drawing Figures

MACHINE FOR MANUFACTURING A TEMPLATE FOR EDGE GRINDING A SPECTACLE LENS

The present invention relates to improvements in a machine for manufacturing a templet for edge grinding a spectacle lens according to the shape of an opening in a spectacle frame designed to hold a lens.

To enable eyeglass lenses to be inserted in the spectacle frame openings designed to hold the lenses, templets of synthetic resin are first produced to match the shape of the openings, and these templets are then placed on a glass grinding machine where the glass lenses are edge-ground to be congruent with the templets.

In a known apparatus of this type, the spectacle frame is clamped to a turntable and is turned about a sensor whose opening contour sensing movement is mechanically transmitted directly to the grinding tool. At the same time, the rotary movement of the turntable is transmitted to the holder of the templet. The operation is semi-automatic and involves complex handling because the mounting of the spectacle frame is difficult and it requires care and skill to move the cutting tool towards the blank for cutting the templet out of the blank. In addition, the dimension of known apparatus of this type is quite large, particularly because of the size of the turntable which must be big enough to receive the entire spectacle frame and a suitable holder therefor. Since, furthermore, the sensor must be centered with respect to the rotary axis of the turntable and must pass therethrough from below, an expensive hollow shaft construction of large diameter is required.

It is the primary object of this invention to improve an apparatus of the indicated type by simply mounting the spectacle frame stationarily on a housing of reduced dimensions and by automatically guiding the movement of the templet cutting tool towards and over the blank for cutting the templet out of the blank in response to the movement of the spectacle frame opening contour sensor along the contour of the opening. All the mechanical movements are electronically controlled.

The above and other objects are accomplished according to the invention in a machine for manufacturing a templet for edge grinding a spectacle lens according to the shape of an opening in a spectacle frame designed to hold the lens, which comprises a housing and a spectacle frame holder supported on the housing for holding the spectacle frame in a plane, and the opening having an axis extending perpendicularly to the plane. A copying sensor is mounted on the housing for rotation about the axis of the opening and for rectilinear displacement in the plane wherein the spectacle frame is held, the sensor sensing the shape of the opening upon rotation thereof. A blank holder is rotatable synchronously with the sensor, and a sliding carriage is mounted on the housing for rectilinear displacement with respect to the blank holder, the sliding carriage carrying a cutting tool for cutting the blank to provide the templet. A plunger is rectilinearly displaceable with the copying sensor and synchronously controls the rectilinear displacement of the sliding carriage and cutting tool, the plunger having an axis extending in the direction of the axis of the spectacle frame opening. A sensing element is mounted in the housing coaxially with the plunger and is spaced therefrom for sensing the distance between the plunger and the sensing element. Mechanical motion transmitting means connects the sensing element to the sliding carriage, and an electronic processing unit is connected to a drive motor for rectilinearly displacing the sliding carriage and to the sensing element, the processing unit controlling the rotational speed of the drive motor so that the distance between the plunger and the sensing element remains constant.

In this structure, the contour sensor is simply held against the contour of the spectacle frame opening during each rotation and this rotation is synchronously transmitted by mechanical transmission means, such as pinions, directly to the blank holder on which the templet is cut out while, at the same time, the rectilinear displacement of the sliding carriage carrying the cutting tools follows the rectilinear displacement of the sensor, the rectilinear displacement being converted into an axial movement coaxial with the axis of rotation. This enables the control to be effected automatically by an electronic processing unit, as will be explained more fully hereinafter. At the same time, the rectilinear displacement of the cutting tool will be effected automatically in response to the rectilinear displacement of the opening contour sensor.

The above and other objects, advantages and features of the present invention will be more fully explained in connection with a now preferred embodiment shown schematically in the accompanying drawing wherein FIG. 1 is a side elevational view, partly in section, of the machine;

Figure 1:
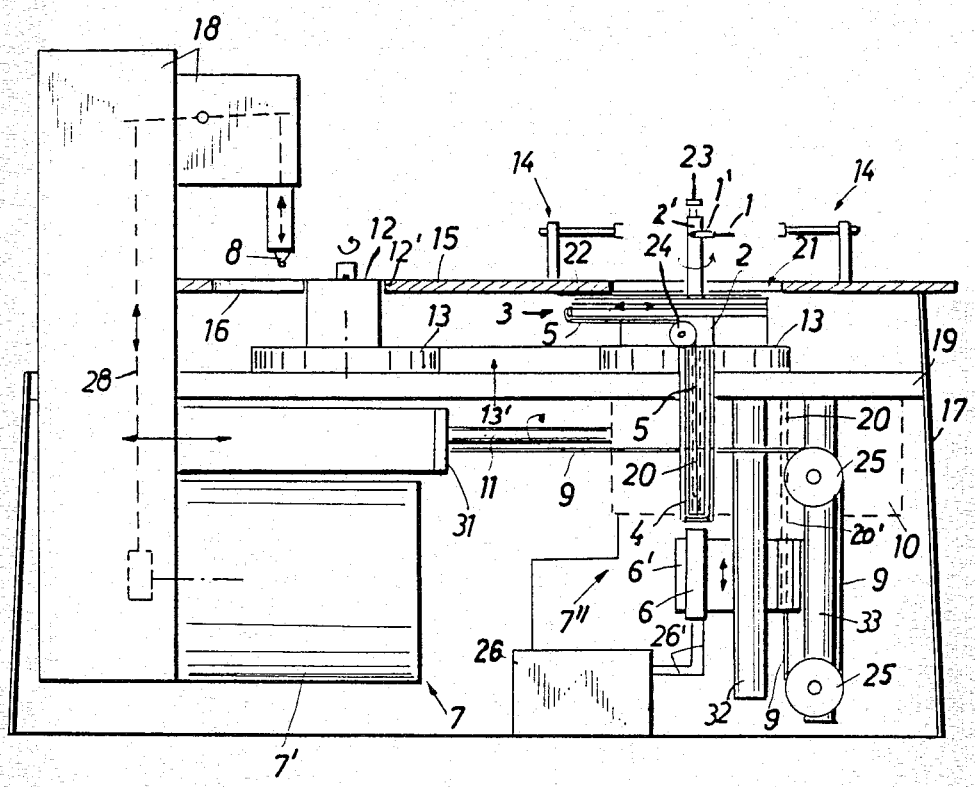
Figure 2:
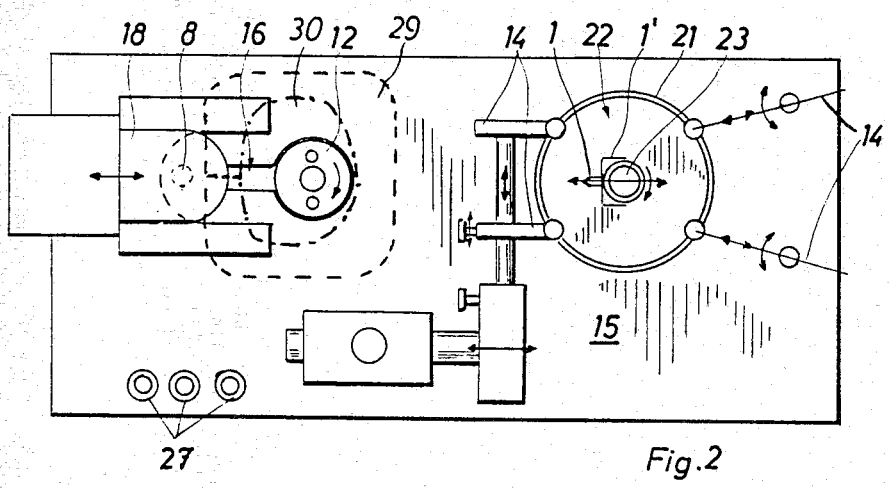
FIG. 2 is a plan view of the machine.

Referring now to the drawing and first to FIG. 1, the machine is shown to comprise housing 17 wherein two essential displaceable mechanisms are mounted, i.e. rectilinearly displaceable mechanism 7 comprising sliding carriage 18 carrying cutting tool 8 for cutting a templet out of a blank and rectilinearly displaceable mechanism 7'' carrying copying sensor 1. Motor 7' is mounted on sliding carriage 18 and serves for the vertical reciprocation of cutting tool 8 to impart thereto a punch motion, transmission 28 (shown in broken lines) connecting motor 7' to cutting tool 8. The rectilinear displacement of sliding carriage 18 moves cutting tool 8 between a starting position remote from the blank towards a working position close to holder 12 for blank 29 (shown in broken line in FIG. 2). The blank rests on holder 12 which is rotatable in bushing 12' defined in housing top 15. The surface of holder 12 is flush with top 15 of housing 17 so that the blank is supported on the holder and the housing top, the housing top defining rectilinear slot 16 in the path of the rectilinearly displaceable cutting tool so that the same may be vertically reciprocated into cutting engagement with blank 29 to cut templet 30 out of the blank during rotation of blank holder 12. The templet is shown in FIG. 2 in dash-dotted lines.

The present machine serves for the manufacture of templet 30 for edge grinding a spectacle lens according to the shape of an opening in a spectacle frame designed to hold the lens. For this purpose, spectacle frame holder 14 is supported on housing 17 for holding the spectacle frame in a plane, and the opening has an axis extending perpendicularly to the plane. As schematically indicated by the arrows in FIG. 2, holder 14 is adjustable in various directions to enable it to hold any type of spectacle frame.

Mechanism 7'' supports copying sensor 1 for rotation about the axis of the spectacle frame opening and for rectilinear displacement in the plane in which the spectacle frame is held, and the sensor senses the shape of the opening upon rotation thereof. In the illustrated embodiment, sensor 1 is carried on bracket 1' which is pivotal to a limited extent on axle 2'. Axle 2' projects through opening 21 in housing top 15 from rotatable shaft 2 supported in a guide of rectilinearly displaceable sliding carriage 3 so that copying sensor 1 is rotatable as well as rectilinearly displaceable. The motor (not shown) for rotating shaft 2 is mounted below false bottom 19 in housing 17 behind drive motor 10 which is connected to rectilinearly displaceable mechanism 7 by threaded spindle 11 rotating in nut 31 affixed to sliding carriage 18 for cutting tool 8. Thus rotation of spindle 11 will rectilinearly displace the sliding carriage. Gear 13 is keyed to shaft 2 and another gear 13 is keyed to blank holder 12, rotary motion transmission gear 13' meshing with gears 13, 13 so that the rotary motion of shaft 2 is transmitted directly to holder 12 so that copying sensor 1 and blank holder 12 rotate in conformity with each other. Gear train 13, 13', 13 is supported on false bottom 19.

As will be obvious, the rectilinear displacement of sliding carriage 3 for copying sensor 1 and its rotation enable the sensor to sense all points of the spectacle frame opening contour and the same holds for the conforming movement of cutting tool 8 so that templet 30 cut out of blank 29 by tool 8 will be congruous to the shape of the opening.

Rotating shaft 2 has a long axial bore open at the lower end of the shaft and plunger 4 is arranged in this axial bore. The plunger is attached to one end of thin steel band 5 whose opposite end is attached to sliding carriage 3, the steel band being guided over pulley 24 rotatably mounted on shaft 2. The plunger is biased by spring 20 arranged in the axial bore of shaft 2. This arrangement serves to reciprocate plunger 4 vertically in response to the horizontal rectilinear displacement of sliding carriage 3.

Electronic sensing element 6 is mounted in the housing coaxially with plunger 4 and is spaced therefrom for sensing the distance between the plunger and the sensing element. The sensing element is affixed to holder 6' which is vertically slidably mounted on column 32 projecting downwardly from false bottom 19. Electric conducting lines 26' connect sensing element 6 to electronic processing unit 26 which controls the rotational speed of drive motor 10 for the rectilinear displacement of sliding carriage 18 so that the distance between plunger 4 and sensing element 6 remains constant. Actuated by respective push buttons 27, the electronic processing unit also energizes motor 7' for vertically reciprocating cutting tool 8 and the motor for rotating shaft 2. Spring 20' is connected between false bottom 19 and holder 6' to bias the holder in a vertical direction. The holder is also mechanically coupled to rectilinearly displaceable mechanism 7 by thin steel band 9 one of whose ends is affixed to holder 6' while the other end thereof is attached to nut 31 affixed to sliding carriage 18, the steel band being trained over two vertically spaced pulleys 25, 25 mounted on vertical column 33 projecting downwardly from false bottom 19. In this manner, the rectilinear horizontal displacement of sliding carriage 18 is translated in a vertical reciprocation of holder 6' and sensing element 6.

Figure 3:
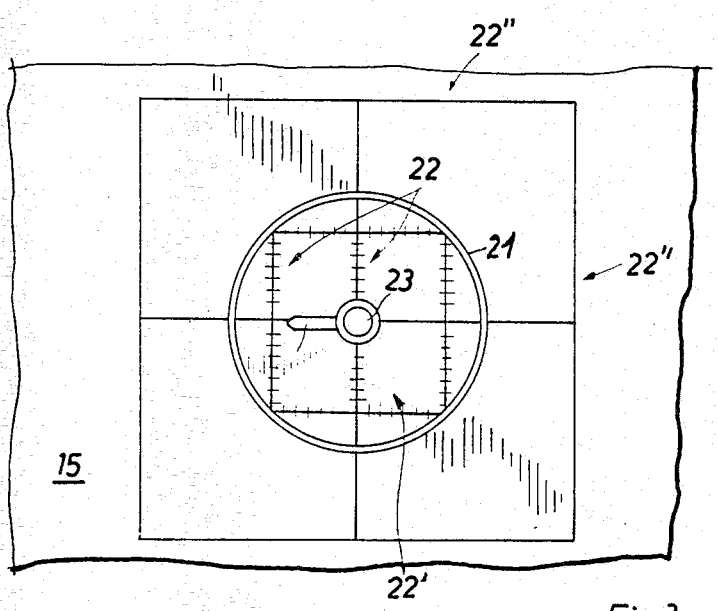
FIG. 3 is an enlarged, fragmentary top view of the machine in the range of the sensor.

Templet 30 for edge cutting a spectacle lens is manufactured in the following manner:

Blank 29, which has a central bore and two aligning bores, is centered on holder 12. The spectacle frame is clamped in position by holder 14 so that one lens opening of the frame is centered over opening 21 in housing top 15. For this purpose and as shown in FIG. 3, the entire circumference of opening 21 carries alignment marking 22'' with a millimeter scale (not shown). A thin disc 21 affixed to sliding carriage 3 also carries alignment marking 22'. Since bracket 1' is pivotal, sensor 1 will be readily able to follow minor inaccuracies in the level of the internal groove in the spectacle frame opening, which receives the lens. The clamping of the spectacle frame in holder 14 is very simple and alignment markings 22', 22'' serve merely for coarse adjustment.

In this phase of the operation, sliding carriage 18 is in the illustrated starting position wherein cutting tool 8 is remote from blank 29 and copying sensor 1 is centered on axle 2' in opening 21. Holder 6 with sensing element 6' is at a considerable distance from the lower end of plunger 4 (which is about 15–20 times the illustrated gap between the sensing element and the plunger).

The templet manufacturing operation is now started by detaching centering plunger 23 from axle 2', the plunger being lifted out of a blind bore in the axle for this purpose. This enables sliding carriage 3 with disc 22 and copying sensor 1 to be rectilinearly displaced until the tip of sensor 1 engages in the groove of the spectacle frame opening where it remains under the bias of spring 20. One of pushbuttons 27 is now depressed to actuate drive motor 10 through electronic processing unit 26 and motor 7' for reciprocating cutting tool 8 but not the motor rotating shaft 2. Drive motor 10 rotates spindle 11 to displace sliding cariage 18 rectilinearly towards blank 29 and the reciprocating tool will cut into the blank. These movements are accompanied by the upward movement of holder 6' with sensing element 6 under the bias of spring 20'. Electronic processing unit 26 is programmed to control the rotational speed of drive motor 10 so that the distance between plunger 4 and sensing element 6 remains constant during the entire templet cutting procedure.

As soon as cutting tool 8 has reached the contour of templet 30 to be cut out of blank 29, which is determined by the predetermined distance or gap between plunger 4 and sensing element 6, the motor rotating shaft 2 is actuated, causing axle 2', which holds copying sensor 1, and blank holder 12 to rotate slowly in unison, the rotational speed conforming to the permissible cutting speed. The sensor will sense the entire contour of the spectacle frame opening during one rotation and, at the same time, the cutting tool will cut out the templet during this rotation. At the end of one rotation of shaft 2 and holder 12, the motor for rotating the shaft will be automatically deactivated.

As soon as templet 30 has been cut out of blank 29, an operation terminating pushbutton 27 will be actuated to cause sliding carriage 18 and holder 6' to return to their starting positions. Axle 2' and sliding carriage 3 are then manually centered again and fixed in position by engaging plunger 23 with the blind bore in axle 2'. As soon as this starting position has been reached, motor 7' and 10 are deactivated, the spectacle frame is removed from holder 14 and repositioned therein for sensing the contour of its other lens opening and to manufacture a conforming templet automatically in the above-indicated manner after the templet and the remainder of the blank have been removed from holder 12 and a new blank is placed thereon.

The housing of the above-described structure measures about 280 mm in length, about 150 mm in width and about 140 mm in height, cutter tool 8 projecting about 60 mm above housing top 15 from gallows-shaped sliding carriage 18.

Electronic processing unit 26 is comprised of commercially available electronic circuit elements programmed for the described operation, a further explanation of this control not being required for those skilled in the art.

What is claimed is:

1. A machine for manufacturing a templet for edge grinding a spectacle lens according to the shape of an opening in a spectacle frame designed to hold the lens, which comprises (a) a housing, (b) a spectacle frame holder supported on the housing for holding the spectacle frame in a plane, and the opening having an axis extending perpendicularly to the plane, (c) a copying sensor mounted on the housing for rotation about said axis and for rectilinear displacement in said plane, the sensor sensing the shape of the opening upon rotation thereof, (d) a blank holder rotatable synchronously with the sensor, (e) a sliding carriage mounted on the housing for rectilinear displacement with respect to the blank holder, the sliding carriage carrying (1) a cutting tool for cutting the blank to provide said templet, (f) a plunger rectilinearly displaceable with the copying sensor and synchronously controlling the rectilinear displacement of the sliding carriage and cutting tool, the plunger having an axis extending in the direction of the axis of the spectacle frame opening, (g) a sensing element mounted in the housing coaxially with the plunger and spaced therefrom for sensing the distance between the plunger and the sensing element, (h) mechanical motion transmitting means connecting the sensing element to the sliding carriage, (i) a drive motor for rectilinearly displacing the sliding carriage, and (j) an electronic processing unit connected to the drive motor and to the sensing element, the processing unit controlling the rotational speed of the drive motor so that the distance between the plunger and the sensing element remains constant.

* * * * *